US008201270B2

(12) United States Patent
Lee

(10) Patent No.: US 8,201,270 B2
(45) Date of Patent: Jun. 19, 2012

(54) LEG PROTECTOR AND PROTECTIVE SKIRT INCLUDING A LEG PROTECTOR

(76) Inventor: Henry Tae Joon Lee, Los Angeles, CA (US)

( * ) Notice: Subject to any disclaimer, the term of this patent is extended or adjusted under 35 U.S.C. 154(b) by 110 days.

(21) Appl. No.: 12/437,946

(22) Filed: May 8, 2009

(65) Prior Publication Data

US 2010/0281592 A1 Nov. 11, 2010

(51) Int. Cl.
*A41D 13/05* (2006.01)
*A41D 13/00* (2006.01)

(52) U.S. Cl. ..... 2/22; 2/455; 2/456; 2/466; 2/2.5

(58) Field of Classification Search ..... 2/455, 464, 2/466, 2.5, 22, 23, 46, 47, 49.5, 62, 215, 2/222, 231, 311–322, 911, 919
See application file for complete search history.

(56) References Cited

U.S. PATENT DOCUMENTS 3,708,799 A * 1/1973 Smithdeal ..... 2/46
3,771,171 A * 11/1973 Mitchell ..... 2/2.5
4,024,584 A * 5/1977 Smith ..... 2/24
4,325,148 A * 4/1982 Livernois ..... 2/465
H7 H * 1/1986 Martone ..... 2/2.5
4,577,346 A * 3/1986 Hall ..... 2/464
4,894,867 A * 1/1990 Ceravolo et al. ..... 2/238
5,034,998 A * 7/1991 Kolsky ..... 2/465
5,375,262 A * 12/1994 Carter ..... 2/23
5,405,312 A * 4/1995 Jacobs ..... 602/5
5,560,042 A * 10/1996 Schlesner ..... 2/46
5,584,072 A * 12/1996 Kim et al. ..... 2/465
5,966,739 A * 10/1999 Wagner ..... 2/23
6,178,556 B1 * 1/2001 Foreman et al. ..... 2/22
6,266,818 B1 * 7/2001 Howland et al. ..... 2/2.5
6,453,791 B1 * 9/2002 Seitzinger ..... 2/2.5
6,543,055 B2 * 4/2003 Howland et al. ..... 2/2.5
6,665,875 B1 * 12/2003 Alonso et al. ..... 2/51
7,266,850 B1 * 9/2007 Strum et al. ..... 2/2.5
7,386,894 B2 * 6/2008 Straiton ..... 2/228
7,490,358 B1 * 2/2009 Beck ..... 2/2.5
7,571,493 B1 * 8/2009 Purvis et al. ..... 2/2.5
7,694,349 B2 * 4/2010 Skottheim ..... 2/69
7,810,167 B2 * 10/2010 Seitzinger et al. ..... 2/2.5
2001/0029621 A1 * 10/2001 Howland et al. ..... 2/2.5
2002/0020000 A1 * 2/2002 Garcia ..... 2/23
2002/0178483 A1 * 12/2002 Beland ..... 2/22
2003/0196256 A1 * 10/2003 Drake ..... 2/455
2003/0226197 A1 * 12/2003 Cramer ..... 2/466
2004/0049827 A1 * 3/2004 Melts ..... 2/22
2004/0088772 A1 * 5/2004 Pollari ..... 2/22
2005/0132475 A1 * 6/2005 Park ..... 2/312
2006/0165948 A1 * 7/2006 Gold ..... 428/76
2006/0191051 A1 * 8/2006 Garcia ..... 2/22
2006/0217015 A1 * 9/2006 Chen ..... 442/36
2006/0248623 A1 * 11/2006 Miller ..... 2/6.6
2007/0016996 A1 * 1/2007 Seitzinger et al. ..... 2/2.5
2008/0098500 A1 * 5/2008 Matic et al. ..... 2/2.5
2008/0134403 A1 * 6/2008 Minns ..... 2/22
2008/0134412 A1 * 6/2008 Lapp et al. ..... 2/161.8
2008/0134419 A1 * 6/2008 Kalaam et al. ..... 2/463

(Continued)

*Primary Examiner* — Bobby Muromoto, Jr.
(74) *Attorney, Agent, or Firm* — Clark Hill PLC

(57) ABSTRACT

A protective skirt for use in martial arts provides leg protectors for providing protection to the thighs of the user in the event of a full-forced attack to the thighs. The leg protectors are removable elements allowing the skirt to be used with out the leg protectors. Alternatively, the leg protectors can be integrated with the skirt.

10 Claims, 4 Drawing Sheets

U.S. PATENT DOCUMENTS

2008/0189822 A1* 8/2008 Johannessen et al. ..... 2/22
2008/0289072 A1* 11/2008 Shin ..... 2/23
2008/0295210 A1* 12/2008 Matic et al. ..... 2/2.5
2009/0025126 A1* 1/2009 Crossman et al. ..... 2/456
2010/0269234 A1* 10/2010 Bennett ..... 2/2.5

* cited by examiner

LEG PROTECTOR AND PROTECTIVE SKIRT INCLUDING A LEG PROTECTOR

FIELD OF THE INVENTION

This invention is generally directed to a protective device for use in connection with martial arts.

BACKGROUND OF THE INVENTION

Often the practice of martial arts involves weapons lighting such as, for example, kendo (Japanese) and kumdo (Korean) sword fighting. In such practice, devices, for example, armor are used to protect the head, the body, and the hand/wrist. These devices allow the practitioner to practice the full extent of their art by allowing the practitioner to strike with full force while avoiding injury to the practitioner's partner. In the practice of sword fencing in kendo and kumdo for instance, a bamboo sword is used to strike the following areas: the head (men-Japanese/mori-Korean), the wrist (kote-Japanese/son-Korean), the waist (do-Japanese/hori-Korean), and the throat (tsuki-Japanese/mok-Korean) and the traditional armor 10 as shown in FIG. 1 is made to protect these areas. The traditional armor 10 generally includes a helmet 12, a chest plate 14, gloves 16, and a skirt 20. The skirt 20 protects the hips and legs in case of a slip from the strike to the waist. The skirt 20 ("tare" in Japanese and "kapsang" in Korean) is constructed from heavy canvas. Because the hips and thighs are not "legal" targets in sword fighting, the skirt provides only moderate protection but does not protect against a full-forced attack.

The skirt 20 is shown in greater detail in FIG. 2. The skirt 20 includes a belt 22 and a plurality of primary panels 24 and secondary panels 26 extending from the belt. The primary panels 24 overlap the secondary panels 26. The skirt 20 includes ties 28 extending from either end of the belt 22. To wear the skirt 20, the user positions the belt 22 such that the secondary panels 26 are proximate the body. The belt 22 is wrapped around the user's waist to provide primary and secondary panels 24, 26 extending in front of and behind the user. The ties 28 are crossed behind the user and then brought together in front of the user where they are tied together to secure the skirt 20 to the user. The secured ties 28 are positioned under one of the panels 24 of the skirt to avoid in advertent untying of the skirt 20.

SUMMARY OF THE INVENTION

Briefly, the present invention discloses a leg protector for attachment to the skirt 20 to provide a protective skirt including a leg protector which protects the thighs of the user from a full-forced attack during sword fighting.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
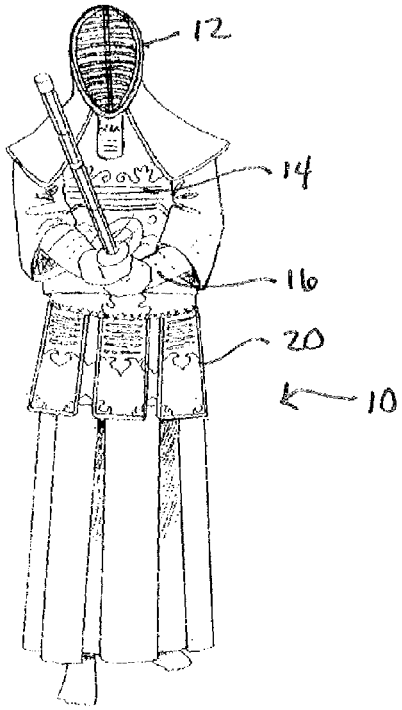
FIG. 1 is a perspective view of prior art body armor.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

Figure 2:
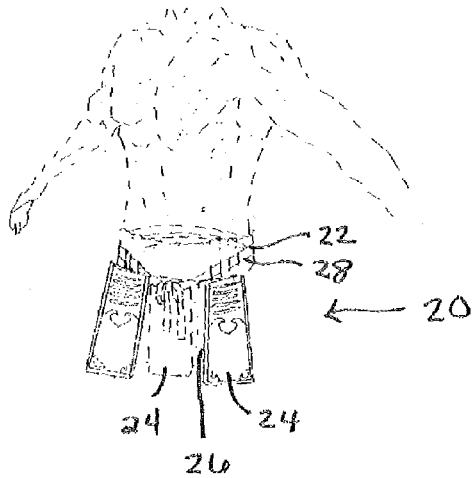
FIG. 2 is a perspective view of the skirt of the prior art body armor.
Figure 3:
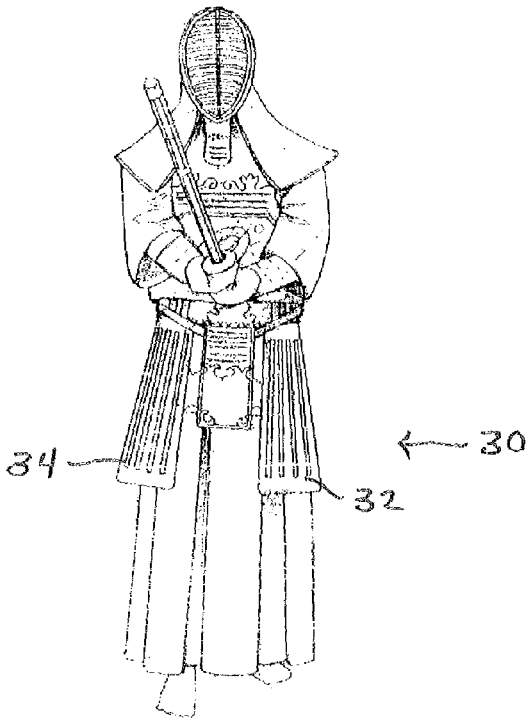
FIG. 3 is a perspective view of the protective skirt.

As shown in FIG. 3 the present invention provides a protective skirt 30 which provides protection of the user's legs during sword fighting or stick fighting sports in which the rules and method of play allow for full-forced strikes to the legs. A new sword fighting sport which allows for such full-forced strikes to the legs has been named by its creator as "Gumtoogi" and a new stick fighting sport allowing for such strikes has been named by its creator as "Bongtoogi". The protective skirt 30 includes a left leg protector 32 and a right leg protector 34 each of which provides a strike panel to protect the users upper legs and in particular the thighs in the event of a full-forced attack, allowing these areas to become primary targets. The protective skirt 30 can be provided by adapting the skirt 20 shown in FIG. 2.

Figure 4:
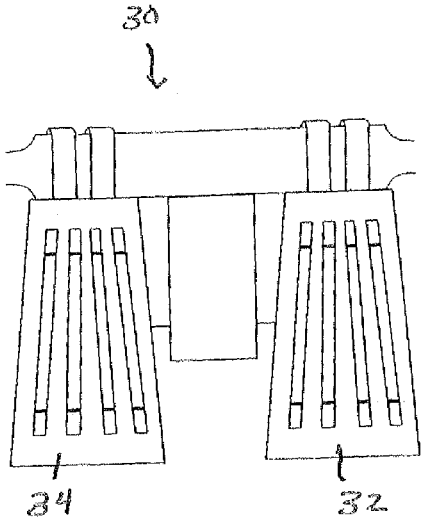
FIG. 4 is a front elevated view of a portion of the protective skirt.
Figure 5:
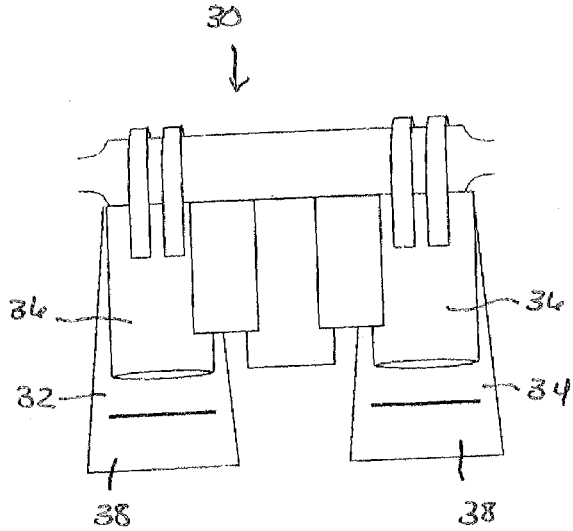
FIG. 5 is a rear elevated view of a portion of the protective skirt.

The protective skirt 30 is shown in greater detail in FIGS. 4 and 5. As shown in FIGS. 4 and 5, the protective skirt 30 is provided by modifying the skirt 20. Each leg protector 32, 34 includes a sock 36 and a shield 38. The leg protectors 32, 34 are identical to one another and therefore only the leg protector 32 will be described in detail with the understanding that the same description applies to the leg protector 34.

Figure 6:
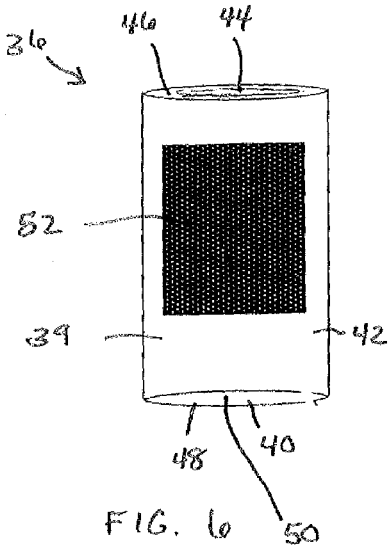
FIG. 6 is front perspective view of the sock of the leg protector.
Figure 7:
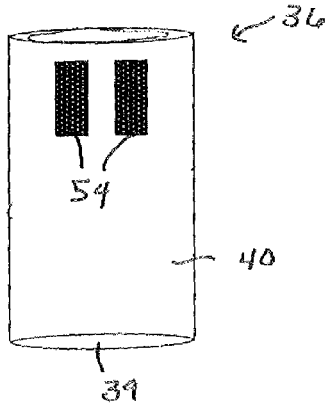
FIG. 7 is a rear perspective view of the sock of the leg protector.

As shown in FIGS. 6 and 7, the sock 36 is generally tubularly-shaped with a generally oval cross-section to generally provide a front portion 39 and a rear portion 40. The sock 36 generally includes an outer surface 42, an inner surface 44, an upper end face 46, and a lower end face 48. A panel passage 50 is defined by the sock 36 for receiving a panel 24 of the skirt as will be described herein. An attachment mechanism 52 is provided on the outer surface 42 of the sock 36 at the front portion 39 and a pair of attachment mechanisms 54 is provided on the outer surface 42 of the sock 36 at the rear portion 40. The attachment mechanisms 52, 54 are for example, mating hook and loop type fasteners. The dimensions of the sock 36 will vary depending upon the size of the user. The dimension of the sock 36 may, for example, have a width of approximately 6⅞" and a height of approximately 10⅛".

Figure 8:
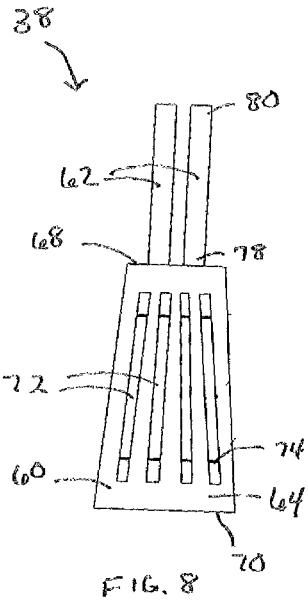
FIG. 8 is a front elevated view of the shield of the leg protector.
Figure 9:
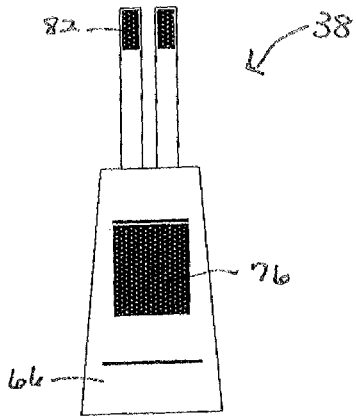
FIG. 9 is a rear elevated view of the shield of the leg protector.

The shield 38 is best shown in FIGS. 8 and 9. The shield 38 generally includes a strike panel 60 and support straps 62. The strike panel 60 is generally trapezoidally-shaped and includes a front surface 64, a rear surface 66, an upper end 68 and a lower end 70. The width of the upper end 68 is smaller than the width of the lower end 70. A plurality of slats 72 are mounted to the front surface 64 of the strike panel 60. The slats 72 are made, for example, from bamboo or plastic. The slats 72 are attached to the strike panel 60 with, for example, leather string 74. An attachment mechanism 76 such as, for example, a loop and hook-type fastener is provided on the rear surface 66 of the strike panel 60 for attachment of the shield 38 to the sock 36 as will be described herein. The shield is preferably formed from heavy cotton canvas and filed with padding. The dimensions of the strike panel will vary depending upon the size of the user. The dimensions of the strike panel may, for example have a width of approximately 6.5 to 6.75 inches at the upper end, a width of approximately 10" to 10.75" at the lower end, and a height of approximately 15.5" to 18".

The support straps 62 extend upwardly from the upper end 68 of the strike panel 60. Lower ends 78 of the straps 62 are attached to the strike panel 60 and upper ends 80 of the straps are free. Attachment mechanisms 82 are provided on the rear surface of the upper ends 80 of the straps 62. The attachment mechanisms 82 are, for example, hook and loop-type fasteners.

Figure 10:
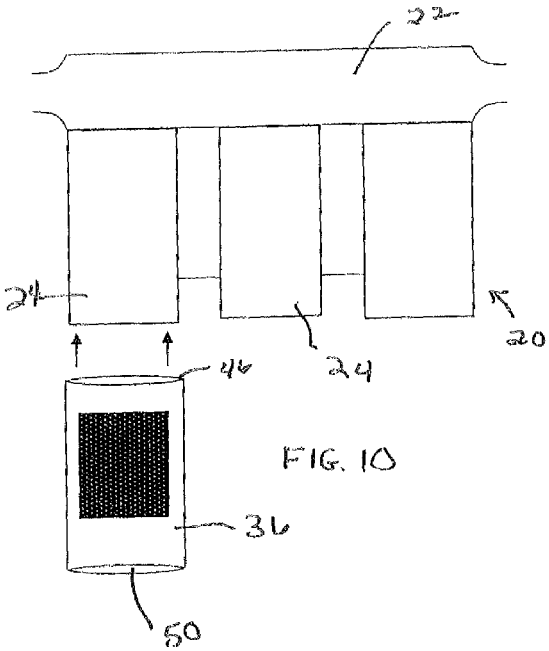
FIG. 10 is an elevated view showing attachment of the sock to the skirt.
Figure 11:
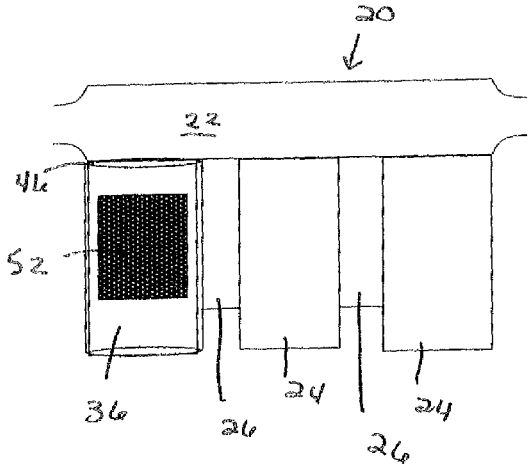
FIG. 11 is an elevated view showing the sock in its final position.

As shown in FIG. 10, attachment of the leg protectors 32 to skirt 20 begins by sliding a primary panel 24 of the skirt 20 in panel passage 50 of the sock 36. The sock 36 is slid upwardly on the panel 24 until the upper end 46 of the sock 36 is proximate the belt 22 of the skirt 20, as shown in FIG. 11. The sock 36 is sized relative to the primary panel 24 such that a friction fit is provided between the inner surface 44 of the sock 36 and the panel 24 of the skirt 20. The sock 36 is mounted to the panel 24 so that the attachment mechanism 52 of the front portion 39 of sock 36 is directed away from the user.

Figure 12:
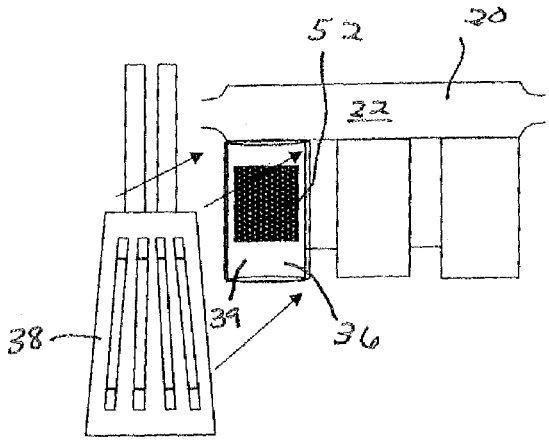
FIG. 12 in a front elevated view showing attachment of the shield of the leg protector to the sock.
Figure 13:
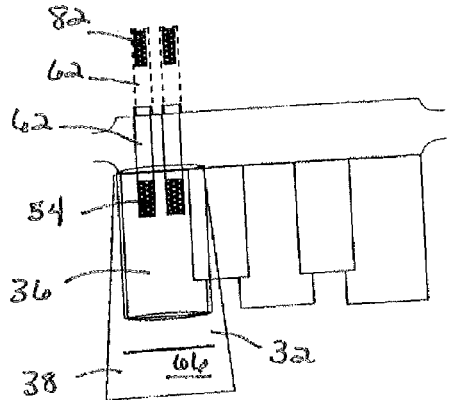
FIG. 13 is a rear elevated view of the protective skirt with the leg protector attached.

Next, as shown in FIG. 12, the shield 38 of the leg protector 32 is mounted to the sock 36 by mating the attachment mechanism 76 on the rear surface 66 of the leg protector 32 to the attachment mechanism 52 on the front portion 39 of the sock 36. As shown in FIG. 13, the support straps 62 are then wrapped over the belt 22 of the skirt 20 and downwardly. The attachment mechanisms at 82 the free ends 80 of the straps 62 are then mated with the attachment mechanisms 54 on the rear portion of the sock 36 to secure the shield 38 to the skirt 20.

Attachment of the leg protectors 32, 34 to the skirt 20 therefore provides a protective skirt which not only protects the user from inadvertent hits to the legs, but also provides for protection from full-forced attacks to the legs. The skirt 30, therefore includes protection to the upper legs as is necessary for the sport of Gumtoogi and Bongtoogi. In addition, the skirt 30 allows for removal of the leg protectors 32, 34 should the user choose to remove them, for example for use in Kendo or Kumdo. The removable leg protectors 32, 34 therefore eliminate the need for the user to purchase different skirts for each sport. Although hook and loop type fasteners and a sock 36 were described for attaching the shield of the leg protector to the skirt 20, other methods of attaching the leg protector are within the scope of the invention. For example, snaps may be used to mate the shields 38 to the sock 36. Alternatively the leg protectors could be tied to the skirt 20 to provide the protective skirt 30.

Although the skirt 30 has been described as including removable leg protectors 32, 34, it is to be understood that the leg protectors 32, 34 can also be permanently integrated in the skirt 30. In the case of permanent attachment of the leg protectors 32, 34, the sock 36 is not required and attachment mechanisms 52, 54, 76 and 82 are not required. Rather, the leg protectors 32, 34 are permanently attached to the belt 22 of the skirt 30 by, for example, sewing the leg protector 32, 34 to the belt 22 or to the panels 24 of the skirt 30.

Although the leg protectors have been described as being formed from heavy cotton canvas material, it is to be understood that a variety of materials can be used to form the leg protectors so long as the material serves to sufficiently protect the legs of the user from full-forced attacks to the legs, allowing the legs to become viable targets.

While preferred embodiments of the present invention are shown and described, it is envisioned that those skilled in the art may devise various modifications of the present invention without departing from the spirit and scope of the appended claims.

The invention claimed is:

1. A protective skirt comprising:

a skirt having a belt and a plurality of panels depending from said belt;

a sock defining a panel passage, said sock including a front attachment mechanism and a rear attachment mechanism, wherein one of said panels of said skirt is positioned within said panel passage;

a leg shield including a strike panel having a front surface and a rear surface, an attachment mechanism on said rear surface of said strike panel, and an attachment strap including an attachment mechanism; and wherein said attachment mechanism on said rear surface of said leg shield mates with said front attachment mechanism of said sock and said attachment mechanism of said strap mates with said rear attachment mechanism of said sock.

2. The protective skirt of claim 1, wherein said strike panel is generally trapezoidally-shaped.

3. The protective skirt of claim 1, wherein said strike panel of said leg shield further includes impact slats.

4. The protective skirt of claim 3, wherein said impact slats are formed from bamboo.

5. The protective skirt of claim 1, wherein said front attachment mechanism of said sock and said attachment mechanism on said rear surface of said strike panel are hook and loop type fasteners.

6. The protective skirt of claim 1 wherein said rear attachment mechanism of said sock and said attachment mechanism of said strap are hook and loop type fasteners.

7. The protective skirt of claim 1 wherein said channel of said sock is sized to provide a friction fit with the panel.

8. The protective skirt of claim 1, wherein said attachment strap of said leg shield extends over said belt of said skirt.

9. The protective skirt of claim 1, wherein said sock and leg shield are removably mounted to said skirt without requiring alteration to said skirt.

10. The protective skirt of claim 1, wherein a first of said panels of said skirt is received by a first sock and a second of said panels of said skirt is received by a second sock.

* * * * *